US007147348B2

(12) United States Patent
Heaton et al.

(10) Patent No.: US 7,147,348 B2
(45) Date of Patent: Dec. 12, 2006

(54) EMERGENCY LIGHTING FIXTURE HAVING ADJUSTABLE REFLECTOR AND LAMP ASSEMBLY

(75) Inventors: Thomas K. Heaton, Burlington, CT (US); Marilyn R. Merced, Middletown, CT (US); Ana S. Bermudez, Bayamon, PR (US); Catherine R. Washburn, Sandy Hook, CT (US); Joseph S. Wegrzyn, Milford, CT (US)

(73) Assignee: Hubbell Incorporated, Orange, CT (US)

( * ) Notice: Subject to any disclaimer, the term of this patent is extended or adjusted under 35 U.S.C. 154(b) by 179 days.

(21) Appl. No.: 10/851,645

(22) Filed: May 24, 2004

(65) Prior Publication Data

US 2005/0259447 A1 Nov. 24, 2005

(51) Int. Cl.

| | |
|---|---|
| ***F21V 21/14*** | (2006.01) |
| ***F21V 14/02*** | (2006.01) |
| ***F21V 19/02*** | (2006.01) |
| ***F21V 17/16*** | (2006.01) |
| *F21V 15/01* | (2006.01) |

(52) U.S. Cl. ..... 362/250; 362/232; 362/238; 362/240; 362/247; 362/285; 362/372

(58) Field of Classification Search ..... 362/250, 362/238, 239, 418–420, 427, 285, 289, 508, 362/514, 232, 372, 241, 240

See application file for complete search history.

(56) References Cited

U.S. PATENT DOCUMENTS

| | | | | |
|---|---|---|---|---|
| 149,555 | A | | 4/1874 | Wilhelm |
| 1,747,283 | A | | 2/1930 | Bean |
| 1,812,919 | A | | 7/1931 | Balder |
| 1,825,641 | A | | 9/1931 | Wolarsky |
| 1,861,883 | A | | 6/1932 | Russell, Jr. |
| 2,212,693 | A | | 8/1940 | Kowalsky |
| 2,586,374 | A | | 2/1952 | Pennow |
| D176,062 | S | | 11/1955 | Calmes |
| 3,829,677 | A | | 8/1974 | DeLlano |
| 4,513,357 | A | | 4/1985 | Nieda et al. |
| 4,713,737 | A | | 12/1987 | Lasker |
| 4,872,098 | A | | 10/1989 | Romano |
| 4,893,224 | A | | 1/1990 | Tinley |
| 5,117,336 | A | | 5/1992 | Scenzi |
| 5,140,504 | A | * | 8/1992 | Sato ..... 362/517 |
| 5,192,129 | A | | 3/1993 | Figueroa |
| 5,249,110 | A | | 9/1993 | Russello |
| 5,325,281 | A | | 6/1994 | Harwood |

(Continued)

FOREIGN PATENT DOCUMENTS

| | | |
|---|---|---|
| DE | 19960981 | 6/2001 |

*Primary Examiner*—Alan Cariaso
*Assistant Examiner*—Leah S Lovell
(74) *Attorney, Agent, or Firm*—Alfred N. Goodman; Mark S. Bicks; Marcus R. Mickney

(57) ABSTRACT

A lighting fixture that is adjustable to allow the emitted light to be aimed and focused to suit the application. The adjustable lighting fixture has a housing having an inner surface. First and second mounting arms extend from the inner surface. A reflector has upper and lower surfaces. First and second mounting members extend from the upper surface and are connected to the first and second mounting arms. A first aperture in the reflector receives a first lamp. The first lamp is movable along a first longitudinal axis through the first aperture to focus the emitted light.

28 Claims, 7 Drawing Sheets

U.S. PATENT DOCUMENTS 5,722,770 A 3/1998 Douglas
6,164,788 A 12/2000 Gemmell
6,572,250 B1 6/2003 Assinder
2002/0191413 A1 12/2002 Hayadawa et al.

* cited by examiner

EMERGENCY LIGHTING FIXTURE HAVING ADJUSTABLE REFLECTOR AND LAMP ASSEMBLY

REFERENCE TO RELATED APPLICATIONS

This application is related to U.S. patent application Ser. No. 10/851,653, entitled Adjustable Double-Arcuate Reflector For An Emergency Lighting Fixture, all concurrently filed herewith in the names of Thomas K. Heaton, Marilyn R. Merced, Ana S. Bermudez, Catherine R. Washburn, and Joseph S. Wegrzyn, the subject matter of each of which is hereby incorporated by reference.

FIELD OF THE INVENTION

The present invention relates to an emergency lighting fixture having an adjustable reflector and lamp assembly. More particularly, the present invention relates to an emergency lighting fixture having an adjustable reflector and lamp assembly to adjust the aim and focus of the emitted light. Still more particularly, the present invention relates to an emergency lighting fixture in which the lamp assembly is adjustable independently of the reflector. The adjustability of the reflector and lamp assembly provides an emergency lighting fixture usable in a variety of environments requiring emergency lighting fixtures.

BACKGROUND OF THE INVENTION

Emergency lighting fixtures are frequently positioned near emergency exits to light emergency egresses from the area, and are commonly used in commercial buildings, residences, and the like. In addition to marking the location of the emergency exit, light emitted from the emergency lighting fixture illuminates the floor in the area of the emergency exit to clearly light the path to the exit.

One problem with existing emergency lighting fixtures is that the egress path is not clearly and uniformly illuminated in the area of the emergency exit. The reflectors in the emergency lighting fixture typically are not configured to clearly and uniformly illuminate the emergency egress. Light is emitted that is not directed to illuminating the emergency egress, thereby wasting light and resulting in an inefficient emergency lighting fixture. A need exists for an emergency lighting fixture that has a reflector configured to clearly and uniformly illuminate the emergency egress.

Another problem with existing emergency lighting fixtures is that the emitted light cannot easily be focused as desired. Some light emitted from the lighting fixture is not directed to illuminating the emergency egress. Light emitted from an emergency lighting fixture that is not directed to illuminating the emergency egress is essentially wasted light because it does not serve the purpose of lighting the emergency egress. Those inefficient emergency lighting fixtures could better light the emergency egress if the lighting fixtures were adjustable to focus the emitted light. A need therefore also exists for an emergency lighting fixture that is adjustable to focus the emitted light.

Another problem with existing emergency lighting fixtures is that the emitted light cannot be aimed as desired. For example, aiming the light emitted from the emergency lighting fixture would allow the light on an installed emergency lighting fixture to be directed to suit any changes in the area in the vicinity of the emergency exit. Furthermore, emergency lighting fixtures that are not capable of being aimed are only best suited for certain environments. For example, some buildings have hallways of various widths. Without being able to adjust the lighting fixture, one type of lighting fixture will not adequately illuminate all of the various hallway widths. Thus, a large inventory of emergency lighting fixtures is required to adequately illuminate the various hallway widths found in a single building. A need therefore also exists for an emergency lighting fixture that is adjustable to aim the emitted light.

Examples of existing lighting fixtures and double arcuate shaped reflectors are disclosed in the following U.S. Pat. No. 1,812,919 to Balder; U.S. Pat. No. 5,140,504 to Sato; U.S. Pat. No. 5,192,129 to Figueroa; and U.S. Pat. No. 5,249,110 to Russello et al.

A need thus exists for an improved lighting fixture.

SUMMARY OF THE INVENTION

Accordingly, it is a primary objective of the present invention to provide an improved lighting fixture.

Accordingly, it is another objective of the present invention to provide an improved reflector for a lighting fixture.

Accordingly, it is another objective of the present invention to provide a reflector for an emergency lighting fixture that provides predictable and uniform levels of lighting.

Accordingly, it is another objective of the present invention to provide an adjustable emergency lighting fixture, thereby allowing the emitted light to be aimed and focused to suit the needs of the area in which the emergency lighting fixture is installed.

The foregoing objects are basically attained by providing an adjustable lighting fixture, including a housing having an inner surface, first and second mounting arms extending from the inner surface; a reflector having upper and lower surfaces, first and second mounting members extending from the upper surface and connected to the first and second mounting arms; a first aperture in the reflector; and a lamp received in the first aperture, the lamp being movable along a first longitudinal axis through the first aperture.

Other objects, advantages and salient features of the invention will become apparent from the following detailed description, which, taken in conjunction with the annexed drawings, discloses a preferred embodiment of the invention.

BRIEF DESCRIPTION OF THE DRAWINGS

Referring now to the drawings that form a part of the original disclosure.

DETAILED DESCRIPTION OF THE INVENTION

Figure 1:
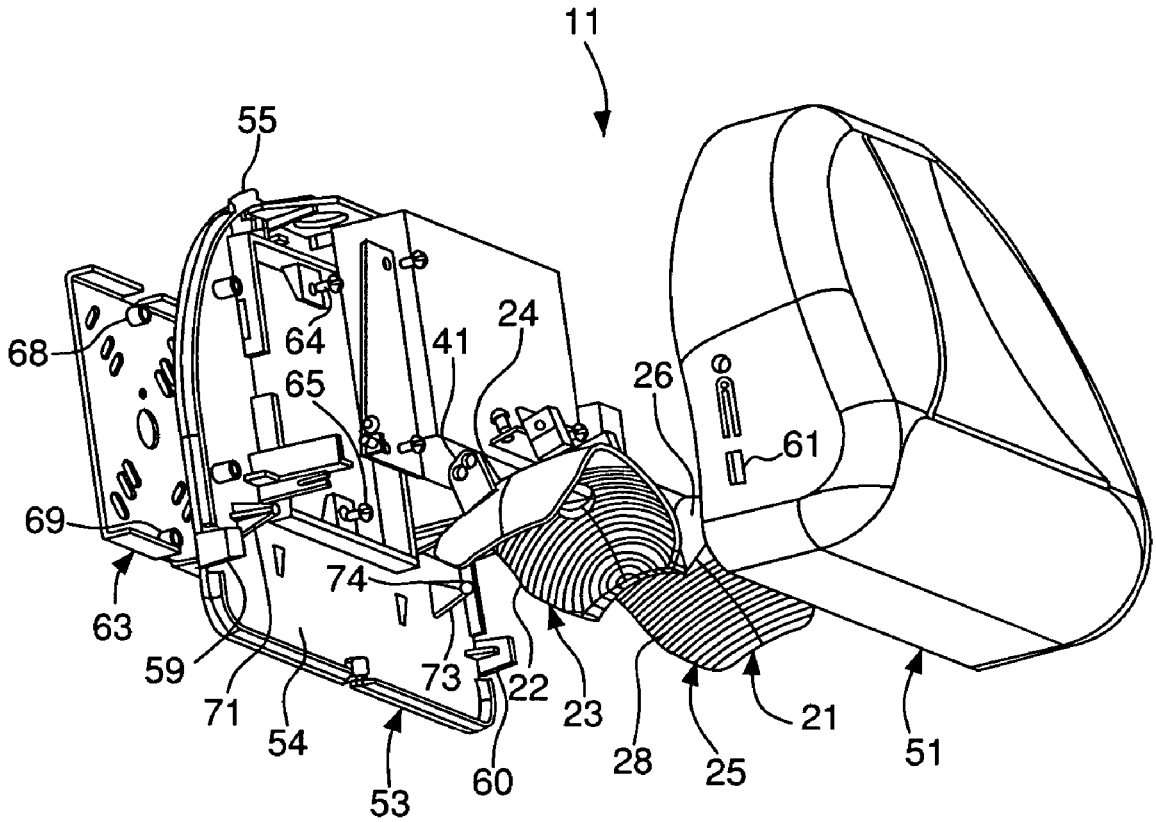
FIG. 1 is an exploded perspective view of an emergency lighting fixture according to the present invention.

As shown in FIGS. 1–10, the present invention provides a lighting fixture 11 that is adjustable to allow the emitted light to be aimed and focused to suit the application. The adjustable lighting fixture 11 has a housing 13 having an inner surface 54. First and second mounting arms 71 and 73 extend from the inner surface 54. A reflector 21 has upper and lower surfaces. First and second mounting members 41 and 43 extend from the upper surface 24 and 26 and are connected to the first and second mounting arms 71 and 73. A first aperture 27 in the reflector 21 receives a first lamp 31. The first lamp 31 is movable along a first longitudinal axis 32 through the first aperture 27 to focus the emitted light. The lighting fixture of the present invention may be used in any environment or application, but is apt to be used as an emergency lighting fixture.

Figure 2:
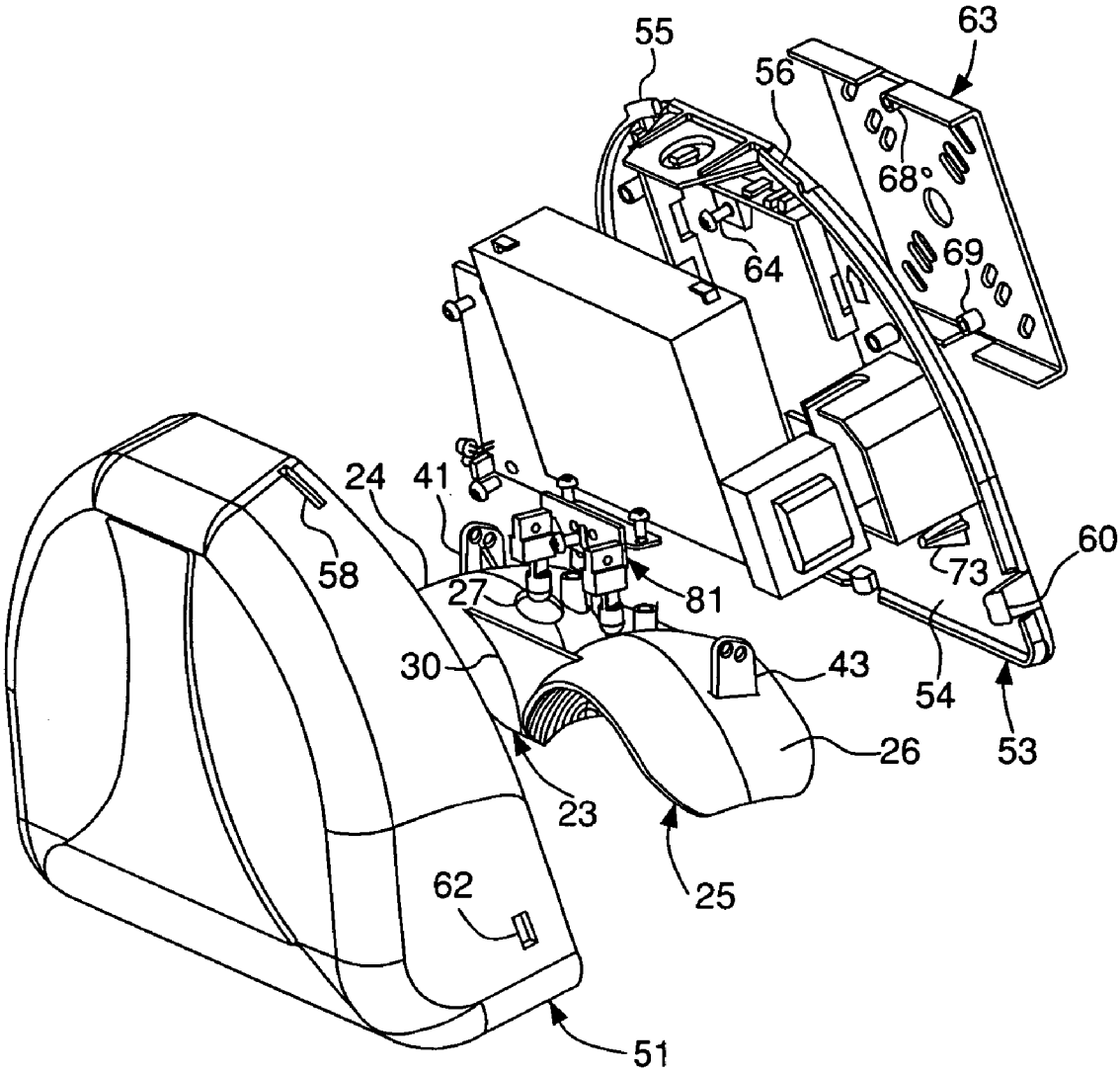
FIG. 2 is an exploded perspective view of the emergency lighting fixture of FIG. 1.
Figure 5:
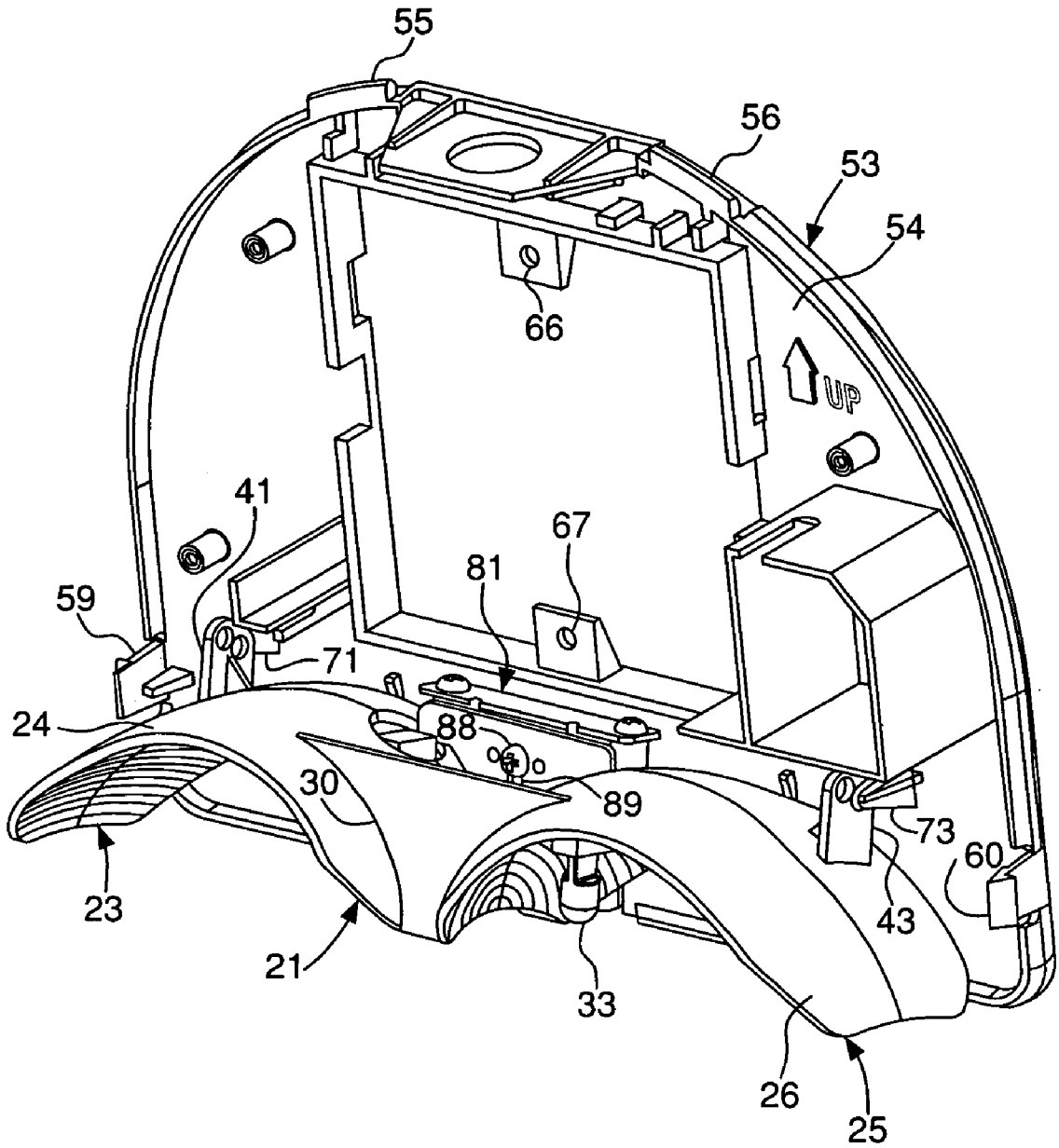
FIG. 5 is a front perspective view of the reflector and bracket assembly connected to the rear plate of the emergency lighting fixture.

The lighting fixture 11 has a housing 13 having a front portion 51 and a rear portion 53, as shown in FIGS. 1, 2 and 5. A plurality of tabs 55 and 56 extend inwardly from an inner surface 54 of the rear portion 53 of the housing 13. A plurality of complementary slots 57 and 58 in the front portion 51 are adapted to receive the tabs 55 and 56. A plurality of latches 59 and 60 extend inwardly from an inner surface 54 of the rear portion 53 of the housing 13. A plurality of complementary slots 61 and 62 in the front portion 51 are adapted to receive the latches 59 and 60. The latches 59 and 60 are flexible and resilient to allow the latches to be easily snapped into and removed from complementary slots 61 and 62. Preferably, the housing is made of plastic.

A mounting plate 63 is connected to the rear portion 53 of the housing 13, as shown in FIGS. 1, 2 and 5. Fasteners 64 and 65 extend through openings 66 and 67 in the rear portion 53 of the housing 13 and are received by complementary fastener holes 68 and 69 in the mounting plate 63. The mounting plate 63 is adapted to secure the lighting fixture 13 to a support.

First and second mounting arms 71 and 73 extend inwardly from the inner surface 54 of the rear portion 53 of the housing 13, as shown in FIGS. 1, 2, 5, 6 and 7. Protrusions 72 and 74 extend inwardly and substantially perpendicularly to the mounting arms 71 and 73. Preferably, the first and second mounting arms 71 and 73 are substantially parallel.

The reflector 21 has an upper surface 24 and a lower surface 22, as shown in FIGS. 1, 2, 3, 5, 6, 7, 8 and 10. Preferably, the reflector has first and second arcuate portions 23 and 25. The first arcuate portion 23 has a first upper surface 24 and a first lower surface 22. The second arcuate portion 25 has a second upper surface 26 and a second lower surface 28. A first aperture 27 in the first arcuate portion 23 and a second aperture 29 in the second arcuate portion 25 are adapted to receive first and second lamps 31 and 33. A bridge 30 may be unitarily formed with and used to connect the first and second arcuate portions 23 and 25 and to add structural stability. Preferably, first and second bridges 30 and 40 are used to connect the first and second arcuate portions 23 and 25. The first bridge 30 is adjacent the front portion 51 of the housing 13 and the second bridge 40 is adjacent the rear portion 53 of the housing. Fastener holes 34 and 35 extend upwardly from the first and second arcuate portions 23 and 25. A plurality of flutes 36 and 37 extend downwardly from the first and second lower surfaces 22 and 28 of the first and second arcuate portions 23 and 25 to direct the emitted light. The vertically downwardly extending flutes 36 and 37 may be substantially parallel. Preferably, the first and second arcuate portions 23 and 25 and the first and second bridges 30 and 40 are unitarily formed. Preferably, the reflector 22 is made of plastic.

First and second mounting members 41 and 43 extend upwardly from the first and second arcuate portions 23 and 25 of the reflector 21, as shown in FIGS. 1–3, 5, 8 and 10. Preferably, the first and second mounting members 41 and 43 are substantially parallel. The first mounting member 41 has first and third openings 44 and 46, each opening being adapted to receive the first protrusion 72 on the first mounting arm 71. The second mounting member 43 has second and fourth openings 45 and 47, each opening being adapted to receive the second protrusion 74 on the second mounting arm 73. Connecting the reflector 21 to the first and second mounting arms 71 and 73 with the first and second openings 44 and 45 results in installing the reflector in a first position (FIG. 6), and with the third and fourth openings 46 and 47 results in the reflector being installed in a second position (FIG. 7). The adjustability of the reflector 21 allows for selectively placing the emitted light from the light fixture 11.

Figure 6:
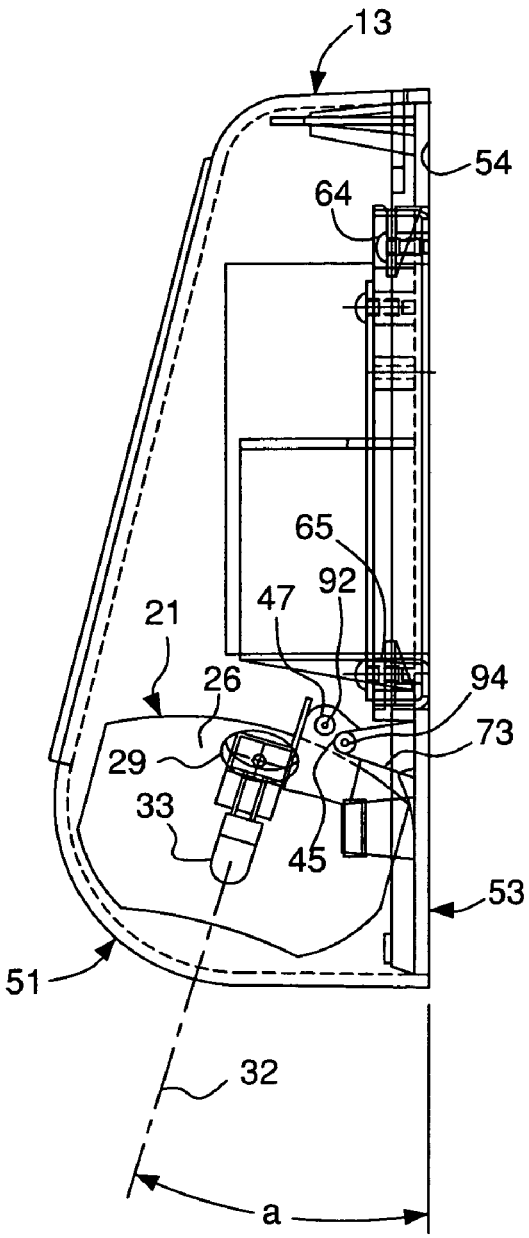
FIG. 6 is a side elevational view showing the reflector installed in a first position.
Figure 7:
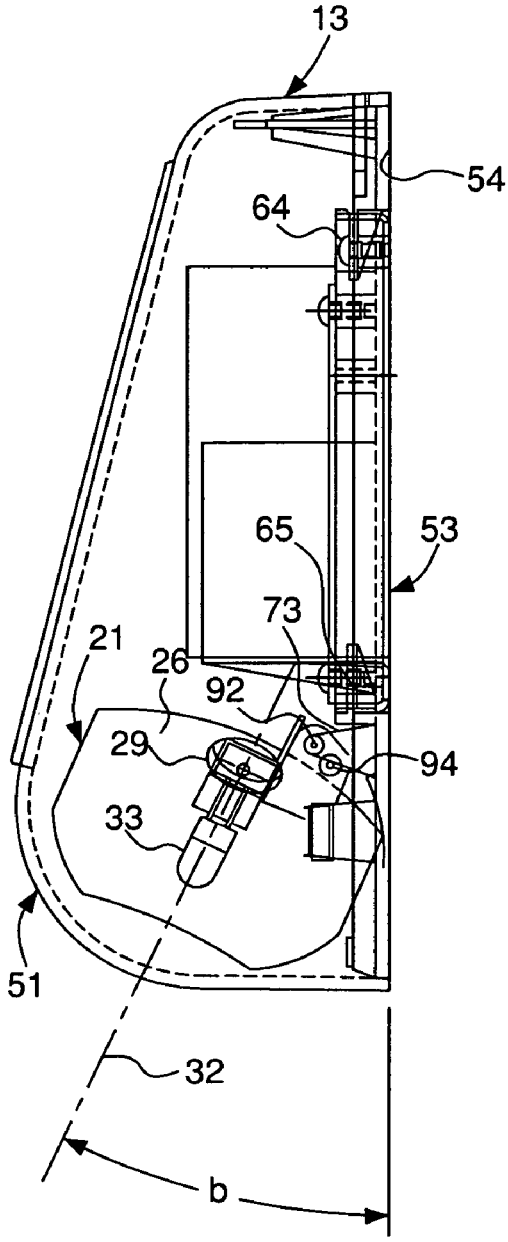
FIG. 7 is a side elevational view showing the reflector installed in a second position.

A first support axis 92 is formed between the first and second openings 44 and 45, as shown in FIGS. 6 and 7. A second support axis 94 is formed between third and fourth openings 46 and 47. Both support axes 92 and 94 extend vertically out of the page, as shown in FIGS. 6 and 7. The support axes 92 and 94 are substantially parallel to one another. Each support axis 92 and 94 is substantially perpendicular to the longitudinal axes 32 through the along which the first and second lamps 31 and 33 are adjustable through the first and second apertures 27 and 29, respectively.

A bracket assembly 81 connects the first and second lamps 31 and 33 to the reflector 21, as shown in FIGS. 1–3, 5, 9 and 10. A member 88 inserted through an elongated opening 89 in a second bracket member 83 and through a complementary opening (not shown) in a first bracket member secures the first and second bracket members together. Sliding the member 88 within the elongated opening 89 adjusts the position of the second bracket member 83, thereby raising or lowering the first and second lamps 31 and 33 with respect to the reflector 21. Thus, the first and second lamps 31 and 33 may be adjusted independently of the reflector, i.e., the lamps may be moved without moving the reflector. First and second sockets 84 and 85 connected to the second bracket member 83 receive the first and second lamps 31 and 33. Fasteners 90 and 91 inserted through fastener holes 86 and 87 in the first bracket member 82 are received by fastener holes 34 and 35 in the reflector 21 to secure the bracket assembly 81 to the reflector.

Preferably, the housing 13 and reflector 21 are injection molded thermoplastic. The front portion 51 of the housing preferably includes a lens, which are ultrasonically welded together to form a one-piece cover. The reflector 21 may be aluminum vacuum-metalized to enhance reflectance properties. Preferably, the mounting plate 63 and lamp bracket assembly 81 are made from sheet steel.

Assembly and Disassembly

Figure 3:
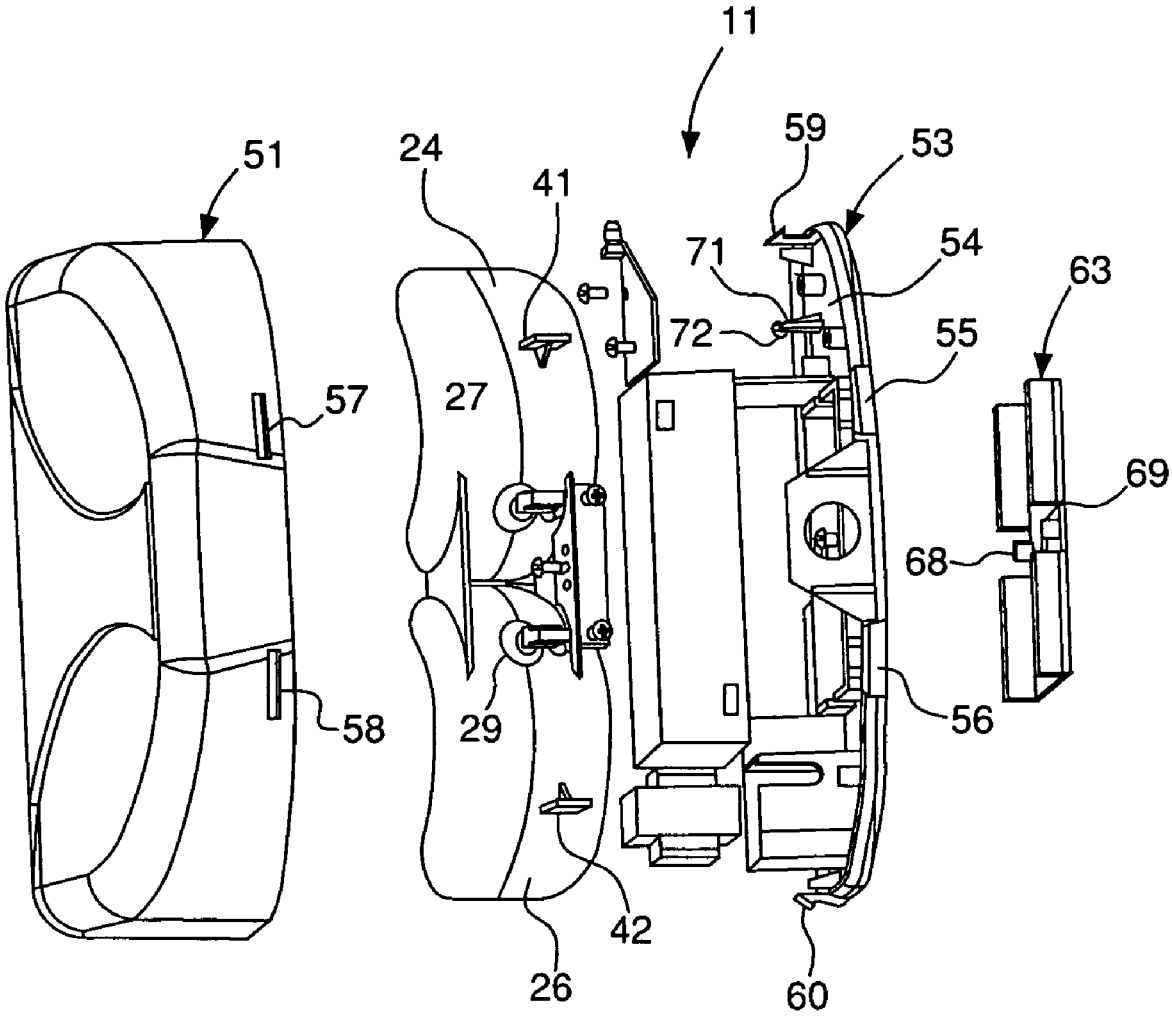
FIG. 3 is a top exploded perspective view of the emergency lighting fixture of FIG. 1.
Figure 10:
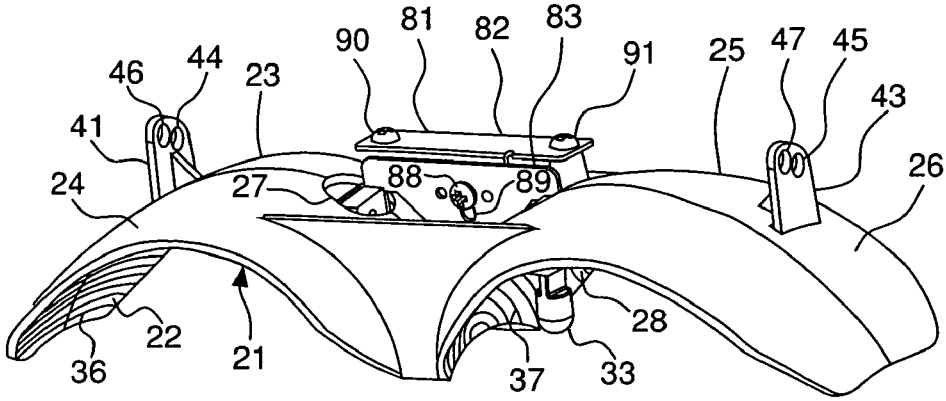
FIG. 10 is a perspective view of the assembled reflector and bracket assembly of FIG. 1.

Exploded perspective views of the disassembled lighting fixture 11 are shown in FIGS. 1–3. The reflector 21 connected to the bracket assembly 81 is shown in FIG. 10. An exploded perspective view of the lighting fixture in which the bracket assembly 81 and reflector are attached to the rear portion 53 of the housing 13 is shown in FIG. 5.

Figure 9:
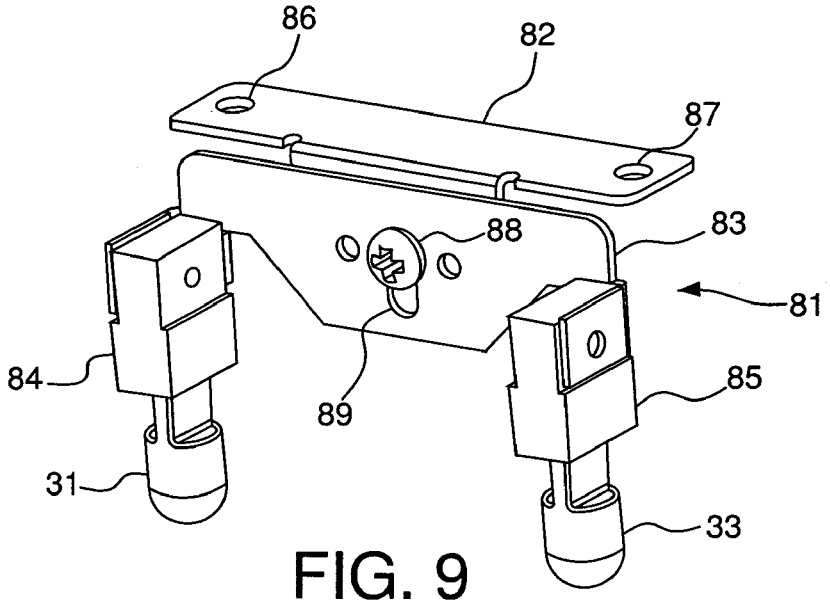
FIG. 9 is a perspective view of the bracket assembly of FIG. 1.

First lamp 31 is connected to the first socket 84 and the second lamp is connected to the second socket 85 of the second bracket member 83, as shown in FIG. 9. Member 88 is inserted through the elongated opening 89 in the second bracket member 83 and through a complementary opening in the first bracket member 82. Once the second bracket member 83 is at the desired height relative to the first bracket member 82, the member 88 is tightened to prevent further movement of the first and second lamps 31 and 33.

Figure 8:
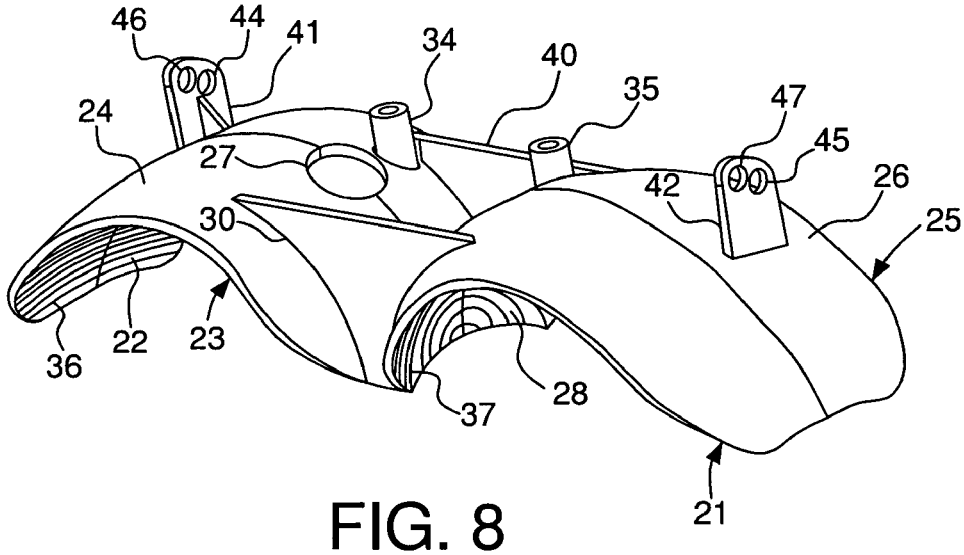
FIG. 8 is a perspective view of the reflector of FIG. 1.

The bracket assembly 81 may then be connected to the reflector 21, as shown in FIG. 10. The first bracket member 82 is positioned to align the first and second fastener holes 86 and 87 (FIG. 9) with the first and second fastener holes 34 and 35 (FIG. 8). Fasteners 90 and 91 are then inserted through the first bracket member fastener holes 86 and 87 and into the aligned reflector first and second fastener holes 34 and 35 to secure the bracket assembly 81 to the reflector 21.

The reflector 21 and lamp assembly 81 may then be connected to the first and second mounting arms 71 and 73 of the rear portion 53 of the lighting fixture housing 13, as shown in FIG. 5. The reflector 21 is connected to the mounting arms to suit the desired lighting pattern for the application in which the lighting fixture is to be used. The protrusions 72 and 74 (FIGS. 1 and 3) on the mounting arms 71 and 73 are snapped into the desired set of openings in the reflector mounting arms, either first and second openings 44 and 45 or third and fourth openings 46 and 47. The first and second openings 44 and 45 correspond to a first installed position of the reflector 21 and the third and fourth openings 46 and 47 correspond to a second installed position of the reflector. The first reflector position shown in FIG. 6 has an angle "a" between the longitudinal axis 32 of the lamps and the inner surface 54 of the rear portion 53 of the housing 13. Preferably, the angle "a" is about 19 degrees. The second reflector position shown in FIG. 7 has an angle "b" between the longitudinal axis 32 of the lamps and the inner surface 54 of the rear portion 53 of the housing 13. Preferably, the angle "b" is about 29 degrees.

As an example, emergency lighting fixtures are often mounted on walls in hallways. Depending on the width of the particular hallway in which the emergency lighting fixture is mounted, the greater the angle between the longitudinal axes of the lamps and the vertical wall on which the fixture is mounted the greater the width of the emitted light pattern. The width of the light pattern is the perpendicular distance from the wall on which the fixture is mounted to the fixture. The length of the emitted light pattern parallel to the wall on which the fixture is mounted is larger when the desired width setting (i.e., the angle between the longitudinal axis of the lamps and the inner surface of the rear portion of the housing) is smaller.

The mounting plate 63 may be connected to a support, such as a vertical wall, to mount the lighting fixture 11. The rear portion 53 of the housing 13 may then be connected to the mounting plate 63, as shown in FIGS. 6 and 7. Fasteners 64 and 65 are inserted through openings 66 and 67 (FIG. 5) in the rear portion 53 of the housing 13 and into fastener holes 68 and 69 (FIG. 2) of the mounting plate 63 to secure the lighting fixture housing 13 to the mounting plate.

Figure 4:
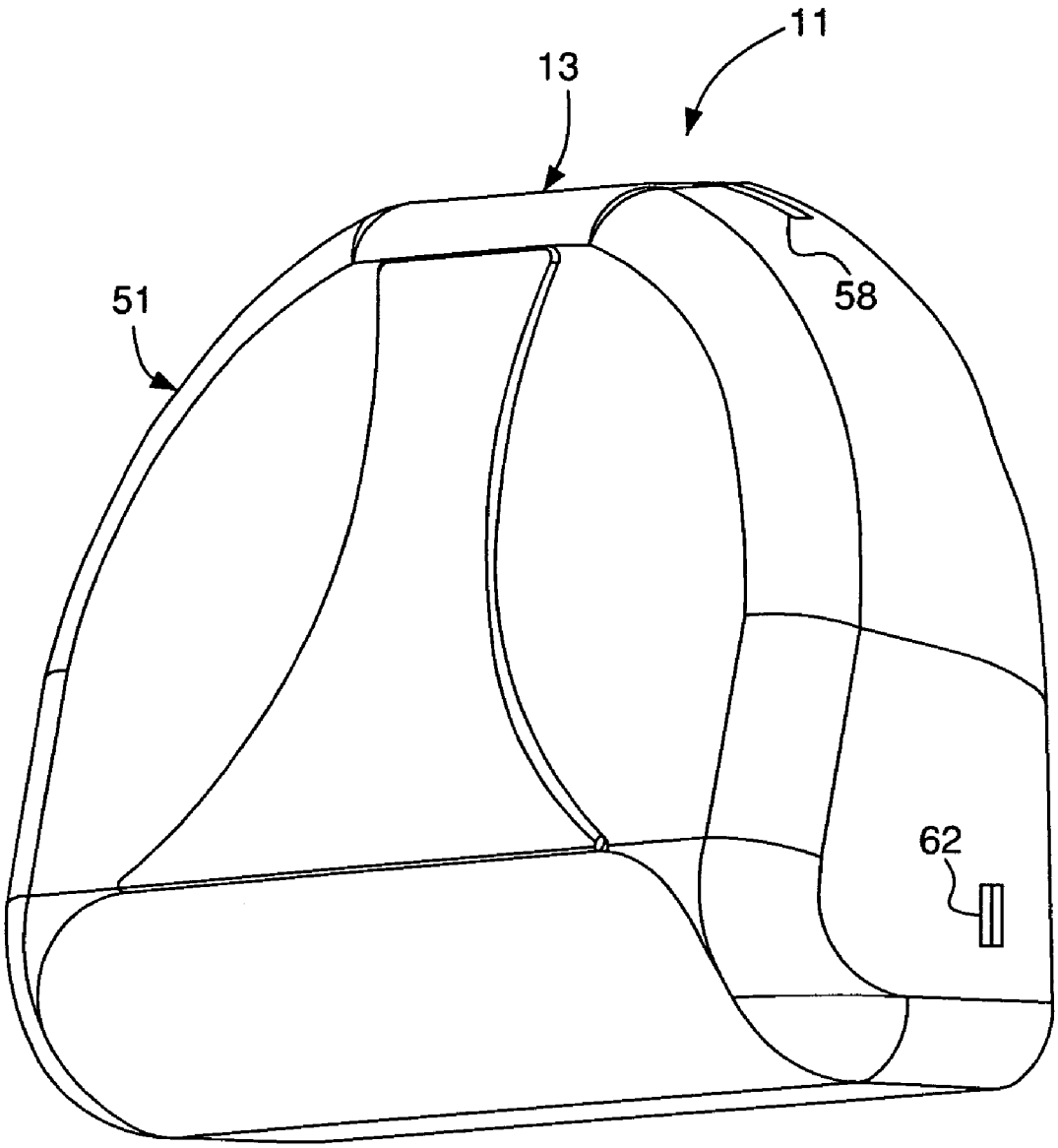
FIG. 4 is a front perspective view of the assembled emergency lighting fixture of FIG. 1.

Once the lamps 31 and 33 are set at the desired height relative to the lower surfaces 22 and 28 of the reflector 21 and the reflector is connected at the desired angle, the front portion 51 of the housing may be connected to the rear portion 53. Slots 57 and 58 in the front portion are attached to the tabs 55 and 56 on the rear portion 53 of the housing 13. The front portion 51 is then pivoted until the latches 59 and 60 flex and snap into complementary openings 61 and 62 in the front portion 51 of the housing 13, as shown in FIG. 4.

The lamps 31 and 33 and the reflector 21 may be easily adjusted by removing the front portion 51 of the housing 13 once the lighting fixture has been mounted. The latches 59 and 60 are disengaged from the slots 61 and 62, such as with a standard slotted screwdriver. The front portion 51 is then lifted to disengage the slots 57 and 58 from the tabs 55 and 56 of the rear portion 53 of the housing 13. Once the front portion 51 of the housing 13 has been separated from the rear portion 53, the emitted light may be modified by adjusting the lamps 31 and 33 or the reflector 21, or both.

The lamps 31 and 33 are adjusted by loosening member 88 in the elongated slot 89 in the second bracket member 83 of the bracket assembly 81. Once the member 88 has been loosened, the second bracket member 83 is adjustable by moving the member 88 along the length of the elongated slot 89. By moving the second bracket member 83, the lamps 31 and 33 are moved along the longitudinal axis 32 (FIGS. 6 and 7). This moves the lamps either closer to or farther from the lower surfaces 22 and 28 of the reflector 21, thereby adjusting the focus of the emitted light due to the distance of the lamps from the lower surfaces of the reflector. The lamps are adjustable independently of the reflector, i.e., adjusting the lamps requires no adjustment of the reflector. Once the desired position of the lamps 31 and 33 relative to the lower surfaces 22 and 28 of the reflector 21 is achieved, the member 88 is tightened, thereby securing the second bracket member 83 to the first bracket member 82 preventing further movement of the lamps.

The reflector 21 is adjustable by snapping the protrusions 72 and 74 on the mounting arms 71 and 73 out of the openings in the reflector mounting members 41 and 43. If the reflector 21 is initially installed in the first position (FIG. 6) using the first and second openings 44 and 45 of the mounting members 41 and 43, the reflector may be reinstalled using the third and fourth openings 46 and 47, and vice versa. Adjusting the reflector between first and second positions includes changing the angle between the longitudinal axis 32 of the lamps and the inner surface 54 of the rear housing, as shown in FIGS. 6 and 7, thereby changing the emitted light pattern.

Once the lamps have been adjusted to a desired position and the reflector has been suitably adjusted, the front portion 51 of the housing 13 is reattached to the rear portion 53 as discussed above.

While advantageous embodiments have been chosen to illustrate the invention, it will be understood by those skilled in the art that various changes and modifications may be made therein without departing from the scope of the invention as defined in the appended claims.

What is claimed is:

1. An adjustable lighting fixture, comprising:

a housing having an inner surface, first and second mounting arms extending from said inner surface;

a reflector having upper and lower surfaces, first and second mounting members extending from said upper surface and connected to said first and second mounting arms;

a first aperture in said reflector; and a first lamp received in said first aperture, said first lamp being movable along a first longitudinal axis through said first aperture independently of said reflector when said lighting fixture is assembled for operation.

2. An adjustable lighting fixture according to claim 1, wherein a second lamp is received in a second aperture in said reflector.

3. An adjustable lighting fixture according to claim 2, wherein said second lamp is movable along a second longitudinal axis through said second aperture independently of said reflector when said lighting fixture is assembled for operation.

4. An adjustable lighting fixture according to claim 2, wherein said reflector has first and second arcuate portions, each of said arcuate portions having one of said first and second apertures therein.

5. An adjustable lighting fixture according to claim 1, wherein said first and second mounting members have first and second openings to connect to first and second protrusions on said first and second mounting arms to install said reflector in a first position.

6. An adjustable lighting fixture according to claim 5, wherein a snap-fit is formed between said first and second mounting members and said first and second mounting arms.

7. An adjustable lighting fixture according to claim 5, wherein said first and second mounting members have third and fourth openings adapted to receive said first and second protrusions on said first and second mounting arms to install said reflector in a second position.

8. An adjustable lighting fixture according to claim 7, wherein an angle between said first lamp in said second position and said inner surface is about 29 degrees.

9. An adjustable lighting fixture according to claim 5, wherein a support axis is formed between said first and second openings in said mounting members, said support axis being substantially perpendicular to said first longitudinal axis.

10. An adjustable lighting fixture according to claim 5, wherein an angle between said first lamp in said first position and said inner surface is about 19 degrees.

11. An adjustable lighting fixture according to claim 1, wherein a bracket connected to said reflector receives said first lamp.

12. An adjustable lighting fixture according to claim 11, wherein a member is received in an elongated opening in said bracket, said member being movable in said elongated opening to move said bracket and said first lamp in said first aperture.

13. An adjustable lighting fixture, comprising:

a housing having an inner surface, first and second mounting arms extending from said inner surface;

a reflector having upper and lower surfaces, first and second mounting members extending from said upper surface and connected to said first and second mounting arms;

first and second apertures in said reflector;

first and second lamps received in said first and second apertures, said first and second lamps being movable along first and second longitudinal axes through said first and second apertures;

first and second openings in said first and second mounting members, said first and second openings connected to said first and second mounting arms to install said reflector in a first position; and third and fourth openings in said first and second mounting members, said third and fourth openings adapted to be connected to said first and second mounting arms to install said reflector in a second position.

14. An adjustable lighting fixture according to claim 13, wherein a snap fit is formed between said first and second mounting arms and said first and second openings on said first and second mounting members.

15. An adjustable lighting fixture according to claim 13, wherein said reflector has first and second arcuate portions, each of said arcuate portions having one of said first and second apertures.

16. An adjustable lighting fixture according to claim 13, wherein a first support axis is formed between said first and second openings, said first support axis being substantially perpendicular to said first and second longitudinal axes.

17. An adjustable lighting fixture according to claim 13, wherein a second support axis is formed between said third and fourth openings, said second support axis being substantially perpendicular to said first and second longitudinal axes when said reflector is in said second position.

18. An adjustable lighting fixture according to claim 13, wherein an angle between said first and second lamps in said first position and said inner surface is about 19 degrees.

19. An adjustable lighting fixture according to claim 13, wherein an angle between said first and second lamps in said second position and said inner surface is about 29 degrees.

20. An adjustable lighting fixture according to claim 13, wherein a bracket connected to said reflector receives said first and second lamps.

21. An adjustable lighting fixture according to claim 20, wherein a member is received in an elongated opening in said bracket, said member being movable in said elongated opening to move said bracket and said first and second lamps in said first and second apertures.

22. An adjustable lighting fixture, comprising:

a housing having an inner surface, first and second mounting arms extending from said inner surface, first and second protrusions on said first and second mounting arms;

a reflector having upper and lower surfaces and first and second arcuate portions;

first and second mounting members extending from said upper surface and connected to said first and second mounting arms;

a first aperture in said first arcuate portion of said reflector;

a second aperture in said second arcuate portion of said reflector;

first and second lamps received in said first and second apertures, said first and second lamps being movable along first and second longitudinal axes through said first and second apertures;

first and second openings in said first and second mounting members, said first and second openings connected to said first and second protrusions on said first and second mounting arms to install said reflector in a first position, a first support axis formed between said first and second openings being substantially perpendicular to said first and second longitudinal axes;

third and fourth openings in said first and second mounting members, said third and fourth openings adapted to be connected to said first and second protrusions on said first and second mounting arms to install said reflector in a second position, a second support axis formed between said third and fourth openings being substantially perpendicular to said first and second longitudinal axes when said reflector is installed in said second position.

23. An adjustable lighting fixture according to claim 22, wherein a snap fit is formed between said first and second protrusions on said first and second mounting arms and said first and second openings on said first and second mounting members.

24. An adjustable lighting fixture according to claim 22, wherein an angle between said first and second lamps in said first position and said inner surface is about 19 degrees.

25. An adjustable lighting fixture according to claim 22, wherein an angle between said first and second lamps in said second position and said inner surface is about 29 degrees.

26. An adjustable lighting fixture according to claim 22, wherein a bracket connected to said reflector receives said first and second lamps.

27. An adjustable lighting fixture according to claim 26, wherein a member is received in an elongated opening in said bracket, said member being movable in said elongated opening to move said bracket and said first and second lamps in said first and second apertures.

28. An adjustable lighting fixture according to claim 26, wherein said bracket is received on said upper surface of said reflector.

* * * * *